United States Patent [19]

Ollis

[11] 4,033,800

[45] July 5, 1977

[54] METHOD OF MAKING AN ELECTRIC CABLE

[75] Inventor: George E. Ollis, Worcester, Mass.

[73] Assignee: United States Steel Corporation, Pittsburgh, Pa.

[22] Filed: Dec. 29, 1972

[21] Appl. No.: 319,564

Related U.S. Application Data

[63] Continuation of Ser. No. 109,287, Jan. 25, 1971, abandoned, which is a continuation-in-part of Ser. No. 784, Jan. 5, 1970, Pat. No. 3,602,632, which is a continuation-in-part of Ser. No. 691,459, Dec. 18, 1967, abandoned.

[52] U.S. Cl. ..... 156/48; 156/51; 156/145; 156/244; 264/103; 264/174; 427/118; 427/358

[51] Int. Cl.[2] ..... H01B 13/14

[58] Field of Search ..... 156/47–48, 156/51–53, 55–56, 172, 191, 296, 244, 145, 500; 174/27, 102 SC, 106 SC, 108, 110 AR, 115–116, 120 C, 120 SC, 36; 425/113; 264/103, 174; 427/118, 358

[56] References Cited

UNITED STATES PATENTS

| | | | |
|---|---|---|---|
| 2,090,510 | 8/1937 | Bower | 156/55 |
| 2,427,507 | 9/1947 | Powell, 3rd et al. | 156/56 |
| 3,143,583 | 8/1964 | Haugwitz | 264/174 |
| 3,218,207 | 11/1965 | Iafrate et al. | 156/48 |
| 3,259,675 | 7/1966 | Bowers | 156/56 |
| 3,329,764 | 7/1967 | Tanges, Jr. | 174/36 |
| 3,340,112 | 9/1967 | Davis et al. | 156/48 |
| 3,412,200 | 11/1968 | Virsberg et al. | 174/102 SC |
| 3,487,149 | 12/1969 | Bunish et al. | 156/244 |

*Primary Examiner*—Charles E. Van Horn
*Assistant Examiner*—Basil J. Lewris
*Attorney, Agent, or Firm*—Rea C. Helm

[57] ABSTRACT

A method of making electric cable having a plurality of electric conductors stranded together with a deformable semi-conducting strand in each valley between the conductors and a shielding composition around and in intimate contact with the conductors and strands. The conductors and strands are stranded together into a stranding die and the plastic composition is forced around them while they are in the stranding die.

3 Claims, 2 Drawing Figures

INVENTOR
GEORGE E. OLLIS
By Martin J. Carroll
Attorney

METHOD OF MAKING AN ELECTRIC CABLE

This application is a continuation of my application, Ser. No. 109,287 filed Jan. 25, 1971, and now abandoned, which is a continuation-in-part of my co-pending application, Ser. No. 784, filed Jan. 5, 1970, and now Pat. No. 3,602,632, which in turn is a continuation-in-part of my application, Ser. No. 691,459, filed Dec. 18, 1967, now abandoned, which relates to a method of making electric cable and more particularly to making oil well logging cables of the general type shown in Ellsworth U.S. Pat. No. 2,927,954 dated Mar. 8, 1960.

These cables include a plurality of insulated electric conductors which are stranded together with valleys between the conductors. Shielding is applied around the stranded conductors and in the valleys. In many cables there is a tendency for the shielding to separate from the insulation during cable flexing in service, thus creating voids. These voids and voids resulting from improper application cause electrostatic interference which is detrimental to the efficiency of the cable. There are also other types of stranded electric cables where it is desirable to obtain good adherence between the conductors and surrounding insulation, shielding or conducting compositions and to avoid voids in the compositions. The normal method of making these types of cable is to first strand the conductors together and then in a separate operation apply the plastic composition.

It is therefore an object of my invention to provide a method of making stranded electric cable in which a plastic composition is applied around the conductors in intimate contact therewith.

Figure 1:
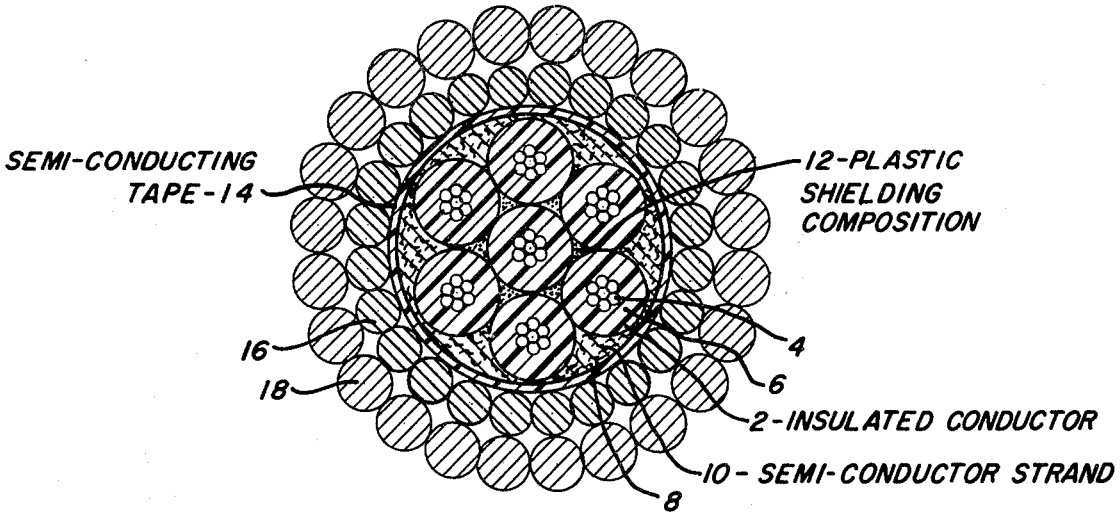
Figure 2:
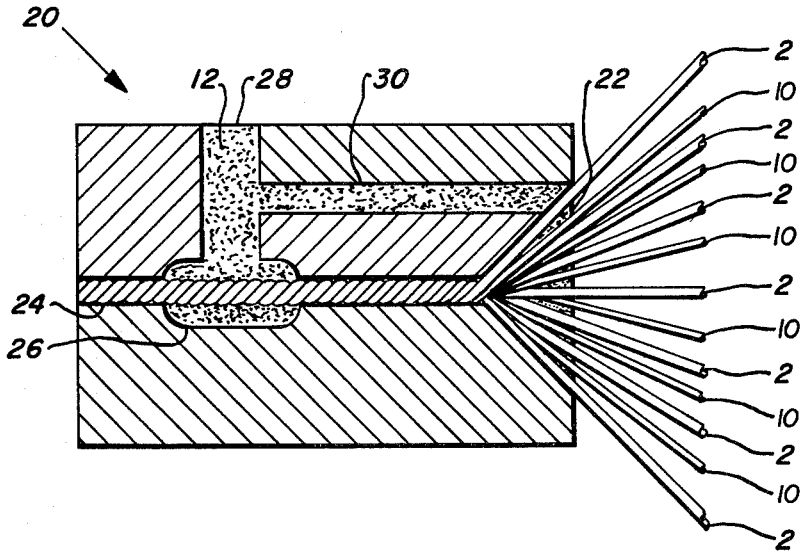

This and other objects will be more apparent after referring to the following specification and attached drawing, in which:

FIG. 1 is a transverse sectional view of oil well logging cable incorporating my invention; and FIG. 2 is a schematic view of apparatus used in the practice of the method of my invention.

Referring more particularly to the drawing, reference numeral 2 indicates insulated electric conductors having a stranded copper conductor 4 surrounded by insulation 6. While any standard type of insulation may be used, it is preferred to use either polypropylene or natural rubber for many types of service. For higher temperatures it is preferred to use chemically cross-linked polyethylene containing thermal carbon black which may be about 40% by volume of the entire mixture. While six conductors are shown stranded around a center core, it will be understood that the invention is equally applicable to any multiple number of conductors. It will be seen that a helical valley 8 is provided between each pair of outer conductors. Each valley is filled with a deformable semi-conductor strand 10. This strand is preferably a cotton strand impregnated with a water emulsion of resin and carbon particles or with the resin and carbon particles suspended in a hydrocarbon solvent. The proportions of resin and carbon particles are not critical and may be varied depending upon the amount of conductivity desired. Two suitable mixtures include 20% by weight of acrylic resin, 30% by weight of carbon particles, and 50% by weight of either water or mineral spirits.

A shielding composition 12 fills voids around the conductors 2 and semi-conducting strands 10 and is in intimate contact therewith. When it is desired that the shielding composition remain plastic in the finished cable the shielding composition consists of 30% to 70% by weight of depolymerized rubber or polybutene with the remainder being carbon particles and plasticizer. Rubber is preferred since it is compatible with any insulation 6 while polybutene is not compatible with polyolefins. The rubber may be either natural or synthetic. The percentages of carbon particles and plasticizer may vary within wide limits depending upon the amount of conductivity and viscosity desired. The viscosity may vary between 300,000 and 3,000,000 centipoises as measured on the Brookfield viscometer. One suitable composition consists of 50% depolymerized natural rubber, 40% conducting carbon black, and 10% coal tar plasticizer. This shielding compound remains plastic in the finished cable so that it will not crack and separate from the conductors, even under severe bending in use. For some methods of well-logging, length stability of the cable is very critical and for such uses it may be desirable to use a vulcanizable shielding composition. This may consist of 25 to 40% by weight of polysulfide rubber, 20 to 45% by weight of carbon black particles, 15 to 35% by weight of a plasticizer, and 1 to 3% by weight of a curing agent. One specific composition which has been successfully used consists of 28% polysulfide rubber, 35% carbon black, 35% chlorinated hydrocarbon, and 2% lead peroxide. This composition will cure at 70° F in 24 to 36 hours into a solid which forms with the conductors and fillers into a compact core. Because of the application of the shielding composition under pressure into and around the conductors and semi-conducting strands as they are being stranded, there will be intimate contact of the composition around the conductors and strands. Surrounding this assembly is a semi-conducting tape or tapes 14 of the type normally used for this purpose. One particular type which may be used is shown in the Ellsworth patent.

A first layer of steel armor wires 16 is helical around the semi-conducting tape 14 with a second layer of armor wires 18 being wound about the first layer with its lay opposite to that of the first layer. If desired, a corrosion inhibitor, not shown, may be provided between the two armor layers and over the outer layer.

As shown in FIG. 2 seven insulated conductors 2 and six deformable strands 10 are stranded together into a stranding die 20. This die has a funnel shaped entry 22, and a cylinder opening 24 therethrough, and a chamber 26 is provided intermediate the ends of the opening 24.

The plastic shielding composition is introduced through a transverse opening 28 into the chamber 26 and through a branch opening 30 into the funnel shaped opening 22.

In operation, the insulated conductors 2 and the deformable strands 10 are brought together into the die entry 22 and the shielding composition is forced around and into the openings within these components both at the entry end and in the chamber 22. An air pressure of up to 7,000 lbs. per square inch is used to compress the semi-conducting material into intimate contact around the conductors and the deformable strands. The deformable strands, which were originally circular in cross section, are deformed in the die so as to fill the majority of the valleys 8. The assembly leaving the die will be round with part of the semi-conducting compound surrounding the outside thereof. In addition to making a better cable, the cost of making the cable is reduced because of the elimination of the separate step of applying the semi-conductors around the conductors which were stranded previously around the core. The remaining operations are conventional and form no part of the present invention.

In making a two conductor insulated conductor, the two conductors are stranded together without a center core but otherwise as shown in FIG. 2 and the insulation is applied in the same way as in the oil well cable except that more clearance is provided between the conductors and opening 24 so as to provide room for more insulation. In making other types of cables the conductors are stranded together with either above or with other strands and the plastic composition applied as described above. A center core may or may not be provided.

Various plastic materials may be applied in the same manner for various purposes. The compositions may be applied to block the transmission of gases or liquids which might enter the cable either at the cable terminal or through a rupture of the cable jacket. The compositions, which may be either insulating or conducting as needed, include depolymerized rubbers, silicone resins, and fibrous-filled organic resins.

While several embodiments of my invention have been shown and described, it will be apparent that other adaptations and modifications may be made without departing from the scope of the following claims.

I claim:

1. The method of making a stranded electric cable having a plastic composition in continuous and intimate contact with the individual conductors throughout the length of the cable which comprises twisting the conductors together and passing the conductors through a stranding die, said stranding die having a long narrow passageway sized for the desired dimension of plastic composition surrounding the stranded conductors, a chamber located intermediate the ends of the passageway and a funnel shaped entrance, while simultaneously applying a plastic under high pressure through a transverse opening in the die into the chamber and at the same time through part of the transverse opening to the surface of the funnel shaped entrance through a branch opening connecting the transverse opening and the funnel shaped entrance.

2. The method of making a stranded electric cable according to claim 5 in which the plastic composition is semi-conducting and which includes providing a plurality of deformable strands of semi-conducting material, applying the plastic composition under pressure into and around the deformable strands while stranding the electric conductors and deformable strands together around a center core with a single deformable strand laid in each valley between conductors and deforming the deformable strands by compression upon passage through the sizing section of the stranding die.

3. The method of making a stranded electric cable according to claim 2 in which the deformable strand includes cotton impregnated with carbon particles; the plastic composition is a vulcanizable mixture of rubber, carbon black, plasticizer and curing agent and air pressure is used for applying the plastic composition.

* * * * *